United States Patent [19]

Ohlsen

[11] Patent Number: 4,924,602

[45] Date of Patent: May 15, 1990

[54] PORTABLE HAIR DRYER

[75] Inventor: Heinz-Jürgen Ohlsen, Wuppertal, Fed. Rep. of Germany

[73] Assignee: Robert Krups Stiftung & Co. KG., Solingen, Fed. Rep. of Germany

[21] Appl. No.: 171,480

[22] Filed: Mar. 21, 1988

[30] Foreign Application Priority Data

Mar. 20, 1987 [DE] Fed. Rep. of Germany ..... 8704225

[51] Int. Cl.[5] ..... A45D 20/12

[52] U.S. Cl. ..... 34/97; 219/365

[58] Field of Search ..... 34/97, 96; 219/365, 219/370

[56] References Cited

U.S. PATENT DOCUMENTS

| | | | |
|---|---|---|---|
| 3,943,329 | 3/1976 | Hlavac | 34/96 X |
| 4,195,217 | 3/1980 | Moller et al. | 34/97 X |
| 4,366,368 | 12/1982 | Stephens, III | 34/97 X |
| 4,471,213 | 9/1984 | Yoshida | 34/97 X |

*Primary Examiner*—Henry A. Bennet

*Attorney, Agent, or Firm*—Peter K. Kontler

[57] ABSTRACT

An electrically operated portable hair dryer wherein the housing has an air inlet at its rear end and an outlet for heated air at its front end. A grid between the outlet and the air heating unit in the housing has a hollow cylindrical outer wall which is confined in the housing, a hollow frustoconical inner wall which is spaced apart from and is surrounded by the outer wall, and a cylindrical innermost wall which is spaced apart from and is surrounded by the inner wall. The walls are integrally connected to each other by radially extending webs. The walls have a common axis, and the diameter of the inner wall decreases in the direction of flow of heated air through the grid. A perforated filter is installed in the housing adjacent the inlet, and a motor-driven impeller is rotatably mounted in the housing between the filter and the heating unit. The holder for the motor is integral with an air guide which surrounds the motor and has radially extending vanes angularly offset with reference to radially extending carriers for the electric heating element or elements of the heating unit.

15 Claims, 3 Drawing Sheets

PORTABLE HAIR DRYER

BACKGROUND OF THE INVENTION

The invention relates to improvements in electrically operated portable hair dryers of the type wherein a housing confines an electric motor which drives a rotary impeller serving to induce a flow of air through an electric heating unit and thereupon to the outlet of the housing.

A hair dryer of the above outlined type normally further comprises a lattice or filter at the inlet of the housing so that the inflowing air passes through the interstices of the filter on its way into the range of the impeller, and a grate at the outlet of the housing. Furthermore, it is customary to provide the hair dryer with a system of guide vanes or analogous air guiding elements which guide the air between the impeller and the heating unit.

The grate at the outlet of the housing normally comprises a set of concentric cylindrical walls which are connected to each other by webs to define apertures for the flow of heated air to the outlet of the housing. The common axis of the walls coincides with the longitudinal axis of the housing of the hair dryer. A drawback of such grates is that they do not ensure a sufficiently uniform distribution of heated air which issues from the housing of the hair dryer. The reason is that, when one considers the combined area of apertures in the grate, the speed of outflowing hot air in certain portions of such combined area is higher than in other portions. This is undesirable because the user or operator of the hair dryer is not in a position to treat the hair in a predictable manner.

The air guiding elements or vanes (which jointly form a so-called guide wheel or diffuser) of conventional hair dryers are normally aligned (in register) with the customary carriers of one or more electric heating elements. The arrangement is normally such that the strip- or plate-like carriers of the heating element or elements extend radially outwardly from and in parallelism with the axis of rotation of the impeller downstream of stationary guide vanes of the guide wheel. The carriers form a substantially star-shaped array and are normally equidistant from each other; the heating element or elements are disposed at the outer sides of such carriers. Each carrier is in register with a guide vane. The reason for such positioning of carriers and vanes in common planes which are parallel to the axis of rotation of the impeller is that this is believed to entail a reduction of the resistance which the carriers and the guide vanes offer to the flow of air toward and along the heating element or elements. It has been found that, though the just described positioning of guide vanes and carriers relative to each other might reduce the resistance which is offered to the flow of air through the guide means and into the range of the heating unit, the heating unit is likely to unduly increase the temperature of air so that the heated air can damage or even destroy the housing of the hair dryer.

OBJECTS AND SUMMARY OF THE INVENTION

An object of the invention is to provide a portable hair dryer wherein the heated air is uniformly distributed not later than at the outlet of the housing.

Another object of the invention is to provide a novel and improved grid for use in the housing of a portable hair dryer between the heating unit and the outlet for hot air.

A further object of the invention is to provide a grid which can be mass-produced at a low cost and can influence the distribution of heated air to a desired extent.

An additional object of the invention is to provide a portable hair dryer which embodies the above outlined grid.

An additional object of the invention is to provide a novel and improved combination of air heating and air guiding means for use in the above outlined hair dryer.

Still another object of the invention is to provide a novel and improved combination of motor supporting and air guiding means for use in the above outlined hair dryer.

A further object of the invention is to provide a novel and improved housing for the hair dryer.

An additional object of the invention is to provide a novel and improved method of preventing overheating of the housing of the hair dryer.

Another object of the invention is to provide hair dryer wherein the housing can be made of inexpensive material which need not stand elevated temperatures but is capable, nevertheless, of standing long periods of extensive use.

One feature of the present invention resides in the provision of an electrically operated portable (hand-held) hair dryer which comprises a preferably elongated tubular housing having an air admitting inlet at one end and an air discharging outlet at the other end. The housing defines an elongated path for the flow of air from the inlet to the outlet, and the hair dryer further comprises motor-operated rotary impeller means which is provided in the housing and is operable to convey air from the inlet to the outlet, means for heating air in the path, and an apertured grid which is provided in the path between the heating means and the outlet. The grid comprises an annular outer wall, at least one annular inner wall which is surrounded by and is spaced apart from the outer wall, and webs which connect the inner and outer walls to each other. The inner wall is inclined with reference to the outer wall. For example, the outer wall can constitute a hollow cylinder, and the inner wall can constitute a hollow conical frustum whose diameter decreases in the direction of flow of heated air through the grid, i.e., the smaller-diameter end of the inner wall is nearer to and the larger-diameter end of the inner wall is more distant from the outlet of the housing. The inner wall can be inclined with reference to the outer wall at an angle of approximately 15–40 degrees, preferably at an angle approximating 25 degrees. The grid can comprise at least one additional inner wall, and the axial length of the at least one inner wall preferably exceeds the axial length of the at least one additional inner wall. Such additional inner wall can surround, or can be surrounded by, the at least one inner wall.

The webs which connect the at least one inner wall with the outer wall have front sides which face the outlet and can be provided with notches, preferably in close or immediate proximity to the outer wall, for the annular rear end portion of an air flow directing nozzle which is preferably separably coupled to the housing in the region of the outlet.

The heating means comprises carriers which are provided in the housing and at least one electric heating element on the carriers. Guide means can be provided in the housing between the inlet and the heating means, particularly between the impeller means and the heating means, to guide the inflowing air into the range of the heating element or elements. The guide means preferably comprises a plurality of air guiding elements (e.g., in the form of guide vanes extending radially of the axis of rotation of the impeller means) which are offset with reference to the carriers of the heating element or elements. The carriers can also extend substantially radially of the axis of rotation of the impeller means, and the guide elements are preferably offset relative to the carriers in the circumferential direction of the impeller means. The holder of the motor for the impeller means can be made integral with the guide means. The axis of rotation of the impeller means coincides, or can coincide, with the common axis of annular walls which form part of the grid.

A second apertured grid (which need not be identical with the aforediscussed grid) can be provided in the housing adjacent the inlet upstream of the impeller means.

The grid in the region of the outlet can be made of or can contain a suitable plastic material. This reduces the cost of such grid and renders it possible to employ a lightweight grid. The webs are or can be integral with the walls.

Another feature of the invention resides in the provision of a novel article of manufacture which can constitute the aforementioned grid in the region of the outlet of the housing of a portable hair dryer to guide air in the housing, particularly to guide heated air toward and into the outlet. The grid comprises an annular outer wall, an annular inner wall which is spacedly surrounded by and is inclined relative to the outer wall, and webs which connect the walls to each other. As mentioned above, the outer wall can constitute a hollow cylinder and the inner wall can constitute a hollow conical frustum. The axis of the cylinder can coincide with the axis of the conical frustum, and the two walls can make an angle of 15–40 degrees, preferably approximately 25 degrees. The walls and the webs can be made of or can contain a plastic material. The grid can further comprise at least one additional annular wall, preferably a substantially cylindrical wall, which is coaxial with the inner and outer walls and is spacedly surrounded by the inner wall or is disposed between and is spaced apart from the inner and outer walls.

The novel features which are considered as characteristic of the invention are set forth in particular in the appended claims. The improved hair dryer itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
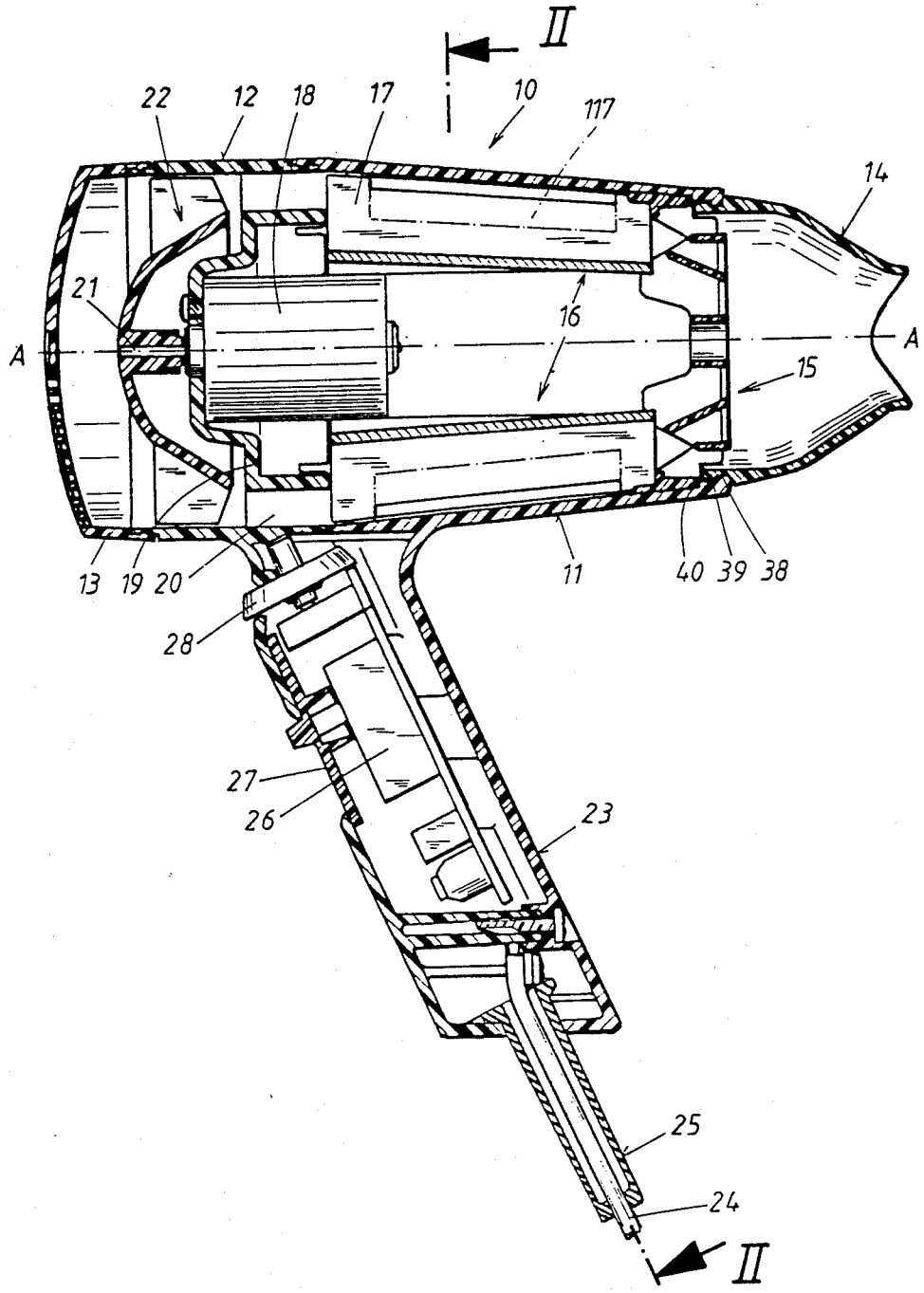
FIG. 1 is a somewhat schematic central sectional view of a portable hair dryer which embodies the invention, an air flow concentrating nozzle being separably coupled to the housing to receive heated air from the improved grid.

The drawing shows only those parts of a portable (hand-held) electrically operated hair dryer 10 which are necessary for full understanding of the invention. For example, the drawing does not show the details of the control circuit for a heating unit 16 and for an electric motor 18 which drives a rotary impeller 22. The drawing also does not show all details of the electric heating unit 16 for air which is caused to flow from the inlet to the outlet of the housing for the motor 18, impeller 22 and heating unit. All such parts which are not specifically shown or are shown only schematically are of connectional design and can be identical with those employed in presently available portable hair dryers, for example, in the so-called "turbo pocket" travel hair dryer #415 which is distributed by the assignee of the present application.

Figure 3:
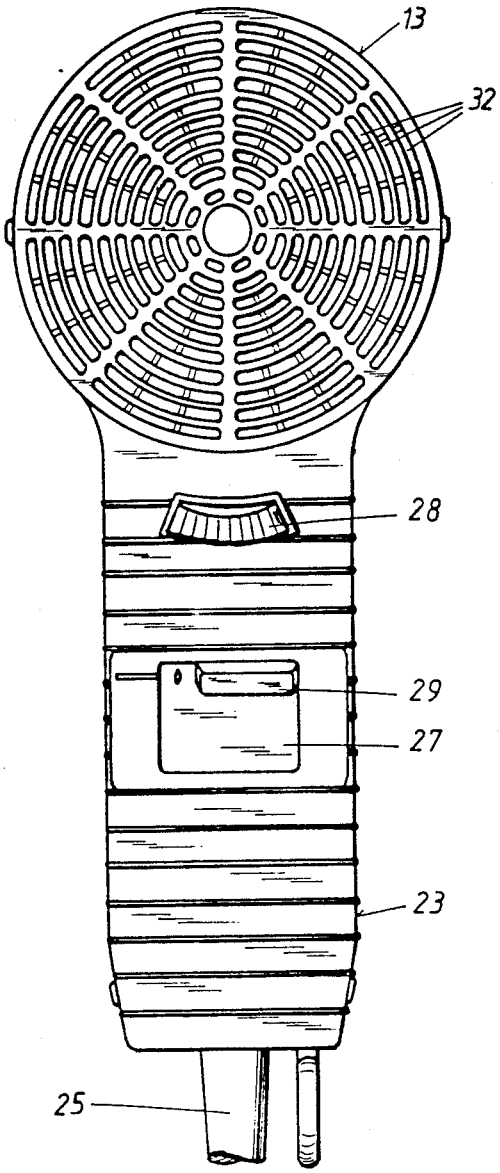
FIG. 3 is a rear elevational view as seen from the left-hand side of FIG. 1.

The housing of the hair dryer 10 comprises a front section 11 and a rear section 12 which is separably or more or less permanently connected to the front section 11 in a manner not forming part of the invention, e.g., by a bayonet mount, by means of deformable pallets which are provided on one of the sections and can enter complementary recesses or sockets in the other section, or in any other suitable manner. The open rear end of the substantially tubular rear section 12 of the housing constitutes an inlet for admission of atmospheric air which is drawn into the interior of the housing when the motor 18 is on to rotate the impeller 22 about an axis A—A constituting the central longitudinal axis of the composite housing. The rear housing section 12 carries a lattice or filter 13 of the type shown in detail in FIG. 3. This filter defines apertures 32 in the form of arcuate slots for admission of fresh atmospheric air which is heated by the heating unit 16 prior to leaving the housing by way of an outlet defined by the open front end of the front section 11. The sections 11 and 12 of the housing define an elongated path for the flow of air from the filter 13 toward the outlet and toward the hair which is to be dried. The filter 13 has a cylindrical front portion which is separably held on the rear end of the housing section 12 by snap action or in any other suitable way. The slots 32 of the filter 13 are defined by concentric rings and radially extending webs of the filter.

Figure 4:
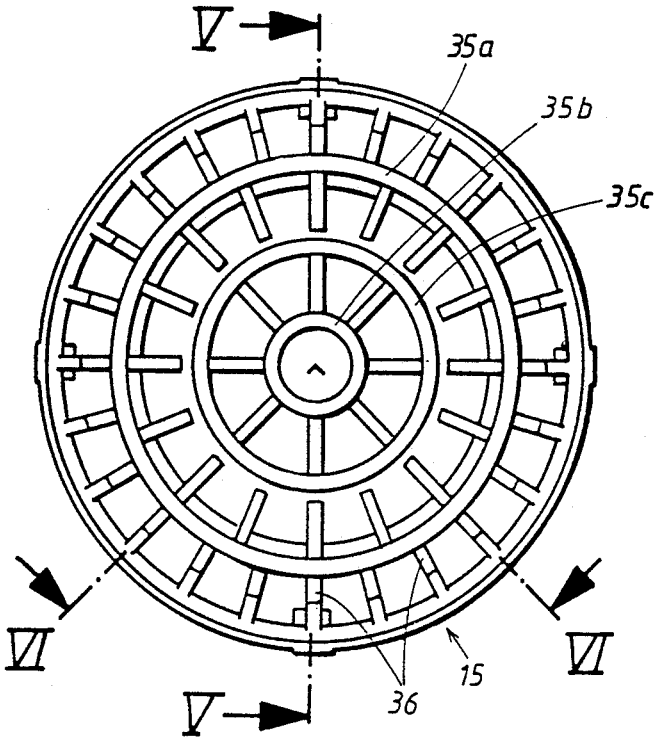
FIG. 4 is an enlarged front elevational view of the grid.
Figure 5:
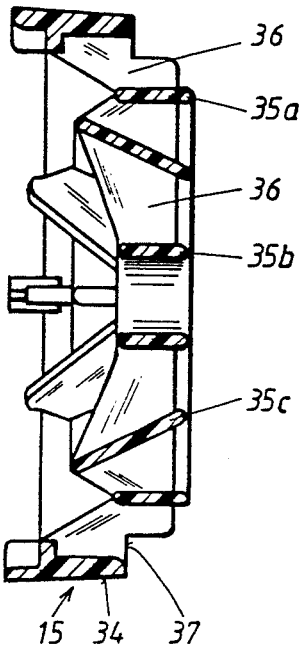
FIG. 5 is a sectional view as seen in the direction of arrows from the line V—V of FIG. 4.
Figure 6:
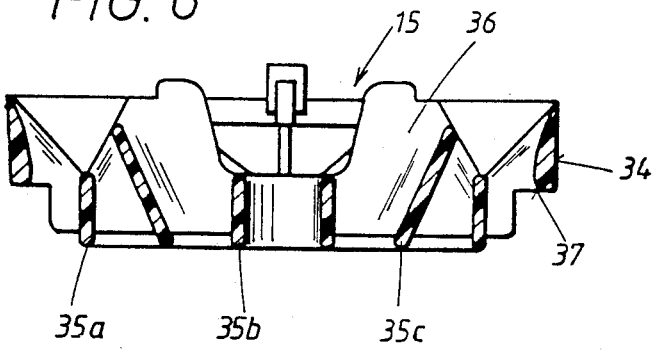
FIG. 6 is a sectional view as seen in the direction of arrows from the line VI—VI of FIG. 4.

In accordance with a feature of the invention, the front section 11 of the housing contains a removable grid 15 which is shown in detail in FIGS. 4 to 6 and serves to direct heated air into the outlet (i.e., into the open front end) of the section 11 and, if necessary, into a detachable air flow directing and concentrating tubular nozzle 14. The grid 15 is preferably a one-piece article which is or can be made (at least in part) of a suitable lightweight plastic material, the same as the housing of the hair dryer 10. The illustrated grid 15 has an annular outer wall 34 which is or which can constitute a hollow cylinder, three inner walls including two hollow cylindrical walls **35*a*, 35*b* and a hollow frustoconical wall 35*c* between the walls 35*a*, 35*b*, and radially extending webs 36 which connect the outer wall 34 with the inner wall 35*a*, the inner wall 35*a* with the inner wall 35c, and the inner wall 35c with the inner wall 35b. The walls 34 and 35a–35c have a common axis which can coincide with the axis A—A. The wall 34 is spaced apart from and surrounds the walls 35a–35c, and the walls 35a–35c** are spaced apart from one another.

The inner wall 35c constitutes a hollow conical frustum which is longer (in the direction of the axis A—A) than the walls 35a, 35b and whose diameter decreases in the direction of flow of heated air from the housing section 11, i.e., toward the outlet of the housing section 11 and into the adjacent annular rear end portion of the nozzle 14. The inclination of the wall 35c with reference to the walls 34 and 35a–35b (and hence with reference to the axis A—A) can be in the range of 15–40 degrees, preferably approximately 25 degrees.

Those webs 36 which extend between the inner wall 35a and the outer wall 34 have front sides or faces facing toward the outlet of the housing section 11 and provided with notches 37 which are immediately adjacent the outer wall 34. These notches receive the annular rear portion of the nozzle 14 when the latter is coupled to the front section 11 of the housing. The rear portion of the nozzle 14 is provided with flexible prongs 39 which can snap into complementary recesses or sockets 38 surrounding the outlet of the front section 11. Such type of coupling allows rapid attachment of the nozzle 14 to and rapid separation of the nozzle from the housing. The arrangement is or can be such that the nozzle 14 can be turned about the axis A—A with reference to the housing section 11 in order to direct the flow of heated air in a desired direction. This is particularly desirable if the outlet of the nozzle 14 is not coaxial with the grid 15 so that a turning of the nozzle relative to the housing section 11 entails a change in the direction of flow or hot air from the hair dryer 10.

The grid 15 is inserted into the housing section 11 from the rear end, and the front end face of the outer wall 34 of the fully inserted grid abuts an internal shoulder 40 of the section 11. The properly inserted grid 15 is then held in an optimum position (as shown in FIG. 1) by several plate- or strip-shaped carriers 17 which form part of the heating unit 16 and serve to mount the electric heating element or elements 117 (indicated schematically by phantom lines) which are activatable to heat air flowing toward the grid 15. As can be seen in FIGS. 5 and 6, the rear end faces or edge faces of the webs 36 are provided with suitable notches or recesses for the adjacent portions of the carriers 17. This even more reliably ensures that the grid 15 is held in an optimum position between the shoulder 40 of the front housing section 11 and the carriers 17 of the heating unit 16.

Figure 2:
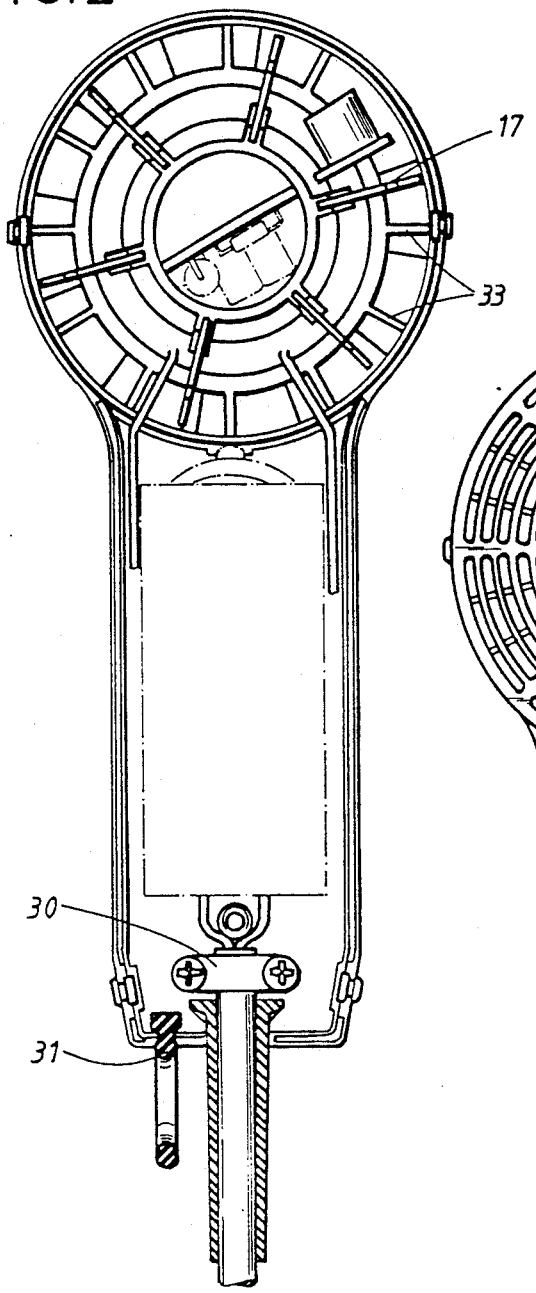
FIG. 2 is an enlarged transverse sectional view of the hair dryer, substantially as seen in the direction of arrows from the line II—II of FIG. 1.

FIG. 2 shows that the carriers 17 are flat bodies which extend substantially radially outwardly of and in parallelism with the axis A—A of the impeller 22 and walls 34, 35a–35c. The helically or otherwise configured wire or wires of the heating elements 117 on the carriers 17 are not specifically shown in the drawing because their exact configuration forms no part of the invention. All that counts is to provide suitable electric heating means for the flow of air in the interior of the housing so that air is adequately heated when it reaches the apertures of the grid 15 and the outlet of the housing of the hair dryer 10.

In accordance with another feature of the invention, the housing sections 11 and 12 contain novel and improved guide means 20 (known as a guide wheel or diffuser) which can be said to constitute a means for converting the circulating body of air downstream of the impeller 22 into a body that flows in substantial parallelism with the axis A—A. The guide means 20 has a plurality of vane-like guide elements 33 which extend radially of the axis A—A and are angularly offset with reference to the carriers 17 of the heating unit 16. This can be seen in FIG. 2, i.e., the vane-like guide elements 33 are not in register with the carriers 17 as in certain presently known hair dryers. Such staggering of the guide elements 33 relative to the carriers 17 results in agitation of conveyed air which, in turn, contributes to more uniform heating of air during flow between the carriers 17 and toward the grid 15. At least some turbulence in the region of the heating unit 16 is desirable and advantageous because this reduces the likelihood of unequal heating and partial overheating of air. Therefore, the entire housing of the improved hair dryer 10 can be made of a reasonably inexpensive plastic material which need not stand elevated temperatures. The same holds true for the grid 15, for the carriers 17 and for the nozzle 14.

In accordance with an additional feature of the invention, the entire guide means 20 is rigid (preferably integral) with a holder or support 19 for the electric motor 18. As shown, the guide elements or vanes 33 of the guide means 20 are integral portions of and extend radially outwardly from the holder 19 for the motor 18. The impeller 22 is mounted on the output shaft 21 of the motor 18 between the holder 19 and the filter 13 for inflowing atmospheric air. The exact construction of the motor 18 and the impeller 22 forms no part of the present invention. The arrangement is or can be such that the motor 18 is capable of driving the impeller 22 at several speeds. When the motor 18 is on, the impeller 22 rotates about the axis A—A and draws air through the slots 32 of the filter 13 and forces the inflowing air to pass between the guide elements 33 of the guide means 20 toward and between the carriers 17 of the heating unit 16. Such air is heated by the heating elements 117 and flows through the apertures of the grid 15 on its way into the nozzle 14 or directly into contact with the hair to be dried.

The sections 11, 12 of the housing are integral with two parts of a composite hollow handle or grip 23 (see FIGS. 1 to 3) which contains the aforementioned control means for the motor 18 and heating unit 16. FIG. 1 shows that the control means includes a conventional electric on-off switch 26 which is concealed behind a slidable plate 27 of the handle 23. The plate 27 has an outwardly extending knob 29 which can be pushed or pulled by a finger in order to shift the movable portion of the switch 26; such movable portion is coupled to the plate 27. The switch 26 can connect the current-consuming parts of the hair dryer 10, or can disconnect such parts from, the source of electrical energy. The switch 26 is located at a level below a wheel 28 a portion of which extends from the hollow handle 23 and can be rotated by a finger to select the optimum speed for the motor 18 and/or the heating action of heating elements 117.

The free end of the handle 23 has an opening for a portion of a protective sheath 25 for an electric cable 24 which carries a plug (not shown) insertable into a household outlet or into another source of electrical energy. A clamp 30 in the handle 23 is attached to the cable 24 immediately adjacent the confined end of the sheath 30 to prevent extraction of the cable from the handle. The sheath 25 serves to prevent flexing of the cable 24 in the region where the cable extends through the bottom end wall of the handle 23. The reference character 31 denotes in FIG. 2 a portion of a built-in loop which can be used to suspend the hair dryer 10 on a hook, on a nail or on a like support when the hair dryer is not in use.

Experiments indicate that the improved grid 15 permits a much more uniform distribution of heat in the flow of air which issues from the housing section 11 than a conventional grid wherein all of the annular walls are hollow cylinders. It was further discovered that the improved grid 15 promotes a flow of heated air in the direction of the axis A—A; this simplifies the task of the user of the hair dryer because the flow of heated air which issues from the outlet of the housing section 11 or from the nozzle 14 is more predictable than the flow of heated air from conventional hair dryers. The aforementioned experiments further indicate that the distribution of heat in the flow of air issuing from the hair dryer 10 and the direction of flow of air is especially satisfactory if the inclination of the wall 35*c* with reference to the axis A—A is within the aforementioned range of 15–40 degrees, preferably close to or exactly 25 degrees.

An advantage of a relatively long hollow frustoconical wall 35*c* (as measured in the direction of the axis A—A) is that such wall can influence the flow of heated air along a relatively long portion of the path between the inlet and outlet of the housing including the sections 11 and 12. The relatively long wall 35*c* can exert a desirable influence upon the direction of flow of heated air toward and into the nozzle 14 or directly against the hair of a customer in a beauty salon or barber shop, or against the hair of a person using the hair dryer at home, in a hotel or motel, or in any other establishment.

The aforediscussed staggering or offsetting of the guide vanes 33 relative to the carriers 17 of the heating unit 16 has been found to significantly reduce the likelihood of overheating of air during flow between the carriers 17 and on toward the grid 15. This is attributable to agitation of cool atmospheric air immediately prior to entry into and during flow in the spaces between the carriers 17. Therefore, the housing of the hair dryer 10 can be made of an inexpensive plastic material which need not stand elevated temperatures.

The quantity of plastic or other material which is used to make the guide vanes 33 and the carriers 17 is the same as in a conventional hair dryer wherein the vanes are aligned with the carriers. All that is necessary is to change the orientation of the vanes 33 relative to the carriers 17 and/or vice versa. It has been found that the agitation of inflowing cool air immediately ahead of and during entry into the heating unit 16 is especially satisfactory if each vane 33 is located exactly or substantially midway between two neighboring carriers 17 (as seen in the circumferential direction of the impeller 22), provided that the number of vanes 33 matches the number of carriers 17.

The making of guide means 20 as an integral part of the holder or support 19 for the motor 18 is desirable and advantageous because this contributes to lower cost of the hair dryer and simplifies the task of assembling the hair dryer since the number of separate parts is reduced as a result of making the guide vanes 33 integral parts of the holder 19.

The illustrated hair dryer 10 is susceptible of numerous modifications without departing from the spirit of the invention. As mentioned above, the inclination of the wall 35*c* of the grid 15 relative to the walls 34, 35*a*–35*b* and axis A—A can be changed within a wide range. Furthermore, the cylindrical wall 35*a* and/or 35*b* can be replaced with a frustoconical wall whose inclination relative to the axis A—A may but need not be identical with that of the wall 35*c*. The number of inner walls can be increased to four or more or reduced to two or one (i.e., to the wall 35*c*). The extent to which the guide elements 33 of the guide means 20 are staggered or offset relative to the carriers 17 for the heating elements 117 of the heating unit 16 can be changed, and the extent of such offset need not be the same for all of the guide elements 33 (see FIG. 2). The number of guide elements 33 can exceed, or can be less than, the number of the carriers 17. The filter 13 can be replaced with a simpler or with a more complex filter, and the nozzle 14 can be omitted or replaced with a different nozzle. All such modifications will be readily comprehended by those skilled in the art upon perusal of the preceding description of the illustrated embodiment of the improved hair dryer.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An electrically operated portable hair dryer comprising a housing having an air admitting inlet and an air discharging outlet and defining a path for the flow of air from said inlet to said outlet; motor-operated rotary impeller means provided in said housing and operable to convey air from said inlet to said outlet; means for heating the air in said path; and an apertured grid provided in said path between said heating means and said outlet, said grid preventing direct access to said heating means by way of said outlet and comprising an annular outer wall, at least one annular inner wall surrounded by and spaced apart from said outer wall, and webs connecting said walls to each other, inner wall being inclined with reference to said outer wall.

2. The hair dryer of claim 1, wherein said outer wall is a substantially cylindrical wall and said inner wall is a substantially frustoconical wall whose diameter decreases in the direction of air flow through said grid.

3. The hair dryer of claim 1, wherein said inner wall is inclined with reference to the axis of rotation of said impeller means at an angle of approximately 25 degrees.

4. The hair dryer of claim 1, wherein said grid comprises at least one additional inner wall and the axial length of said at least one inner wall exceeds the axial length of said at least one additional inner wall.

5. The hair dryer of claim 1, wherein said inner wall has a smaller-diameter end nearer to and a larger-diameter end more distant from said outlet.

6. The hair dryer of claim 1, wherein said webs have front sides facing said outlet and notches in said front sides, and further comprising an air flow directing nozzle having an annular rear end portion extending into said notches and secured to said housing.

7. The hair dryer of claim 6, wherein said notches are adjacent said outer wall.

8. The hair dryer of claim 6, further comprising means for separably coupling said nozzle to said housing.

9. The hair dryer of claim 1, wherein said heating means includes carriers provided in said housing and at least one electric heating element on said carriers, and further comprising guide means provided in said housing between said heating means and said inlet, said guide means comprising air guiding elements which are offset with reference to said carriers.

10. The hair dryer of claim 9, wherein said carriers are disposed substantially radially of the axis of rotation of said impeller means and said air guiding elements include vanes which are angularly offset with reference to said carriers.

11. The hair dryer of claim 9, further comprising a motor holder in said housing, said holder being integral with said guide means.

12. The hair dryer of claim 1, wherein said outer wall is a hollow cylinder having an axis which coincides with the axis of rotation of said impeller means, said at least one inner wall including a hollow conical frustum having an axis coinciding with the axis of said hollow cylinder, the diameter of said conical frustum decreasing in a direction toward said outlet and said grid further comprising a second hollow cylindrical wall spaced apart from said outer and inner walls, surrounded by said outer wall and coaxial with said conical frustum.

13. The hair dryer of claim 1, wherein said webs extend substantially radially of said annular walls.

14. The hair dryer of claim 1, further comprising a lattice provided in said housing in the region of said inlet.

15. The hair dryer of claim 1, wherein said grid contains a plastic material and said webs are integral with said walls.

* * * * *